US007553425B2

(12) United States Patent
Stern et al.

(10) Patent No.: US 7,553,425 B2
(45) Date of Patent: Jun. 30, 2009

(54) SCREEN FOR SWIMMING POOL SKIMMER AND METHOD OF USING SAME

(76) Inventors: Samuel B. Stern, 1 Edgemoor Rd., Cheltenham, PA (US) 19012; Margaret Quarry, 7511 Rowland Ave., Cheltenham, PA (US) 19012

( * ) Notice: Subject to any disclaimer, the term of this patent is extended or adjusted under 35 U.S.C. 154(b) by 0 days.

(21) Appl. No.: 11/762,355

(22) Filed: Jun. 13, 2007

(65) Prior Publication Data

US 2008/0308478 A1 Dec. 18, 2008

(51) Int. Cl.
*E04H 4/12* (2006.01)

(52) U.S. Cl. ..... 210/776; 210/791; 210/167.1

(58) Field of Classification Search ..... 210/167.1, 210/167.12, 232, 238, 416.1, 416.2, 460, 210/470, 471, 776, 791
See application file for complete search history.

(56) References Cited

U.S. PATENT DOCUMENTS 828,674 A * 8/1906 Maynard ..... 210/238
3,677,408 A * 7/1972 Dinizo, Jr. ..... 210/167.11
5,217,610 A * 6/1993 McClain et al. ..... 210/223
6,007,714 A * 12/1999 Keith ..... 210/167.12
6,471,856 B1 * 10/2002 Keith ..... 210/167.12
6,932,899 B2 * 8/2005 Bonelli et al. ..... 210/85
2002/0153298 A1 * 10/2002 Blaze ..... 210/238

* cited by examiner

*Primary Examiner*—Fred Prince
(74) *Attorney, Agent, or Firm*—Dann, Dorfman, Herrell and Skillman, P.C.

(57) ABSTRACT

A skimming screen for a swimming pool filtration system is disclosed. The skimming according to the invention includes a support frame having a central opening and a mesh fabric or screen material attached to the support frame so as to extend over substantially the entire area of the central opening. The support frame and the screen material are shaped and dimensioned to cover the intake orifice of the suction line when a strainer basket is removed for cleaning. A method of using the skimming screen to facilitate cleaning of the strainer basket is also disclosed.

15 Claims, 4 Drawing Sheets

SCREEN FOR SWIMMING POOL SKIMMER AND METHOD OF USING SAME

BACKGROUND OF THE INVENTION

Swimming pools, particularly in-ground pools, include one or more skimming drains or skimmers. The skimmers are adapted and positioned to receive surface water from the pool and to remove floating debris such as leaves, twigs, and insects, which would otherwise clog the pool filter. The known skimmers include a strainer basket which sits in a chamber over an intake orifice to which a suction line is attached. With this arrangement, the surface water is drawn through the strainer basket which catches the floating debris.

The strainer basket must be cleaned from time to time in order to prevent the suction line from being blocked by the debris which accumulates in the strainer basket. At such times it becomes necessary to turn off the pool filtration pump so that debris will not be drawn into the suction line and possibly into the pump or the filter where it can cause damage. The need to shut down the pump and filter system is inconvenient at best, and can result in a substantial build up of debris floating on the water surface because the debris is not being skimmed off for an extended period of time.

Accordingly, it would be advantageous to have a means or method for cleaning the strainer basket of a pool skimmer that eliminates the need to shut down the pool pump and filter.

SUMMARY OF THE INVENTION

In accordance with one aspect of this invention there is provided a skimming screen for a swimming pool. The skimming screen includes a support frame that has a central opening. A mesh fabric or screen material is attached to the support frame so as to extend over substantially the entire area of the central opening. The support frame and the screen material are shaped and dimensioned to fit on the intake orifice of a skimmer drain suction line. A handle that extends from the support frame is optionally provided to facilitate placement of the skimming screen on the intake orifice and for removing the skimming screen therefrom.

In accordance with another aspect of the present invention, there is provided a method for cleaning a swimming pool skimmer. The method includes the steps of providing a skimming screen having a support frame that has a central opening and a screen attached to the support frame and extending over substantially the entire area of the central opening. The method further includes the steps of removing the strainer basket from the intake orifice of the skimmer suction line and placing the skimming screen on the intake orifice while the strainer basket is cleaned. The skimming screen is removed when the strainer basket is replaced on the intake orifice.

BRIEF DESCRIPTION OF THE DRAWINGS

The foregoing summary and the following detailed description will be better understood with reference to the accompanying drawings, wherein.

DETAILED DESCRIPTION

Figure 1:
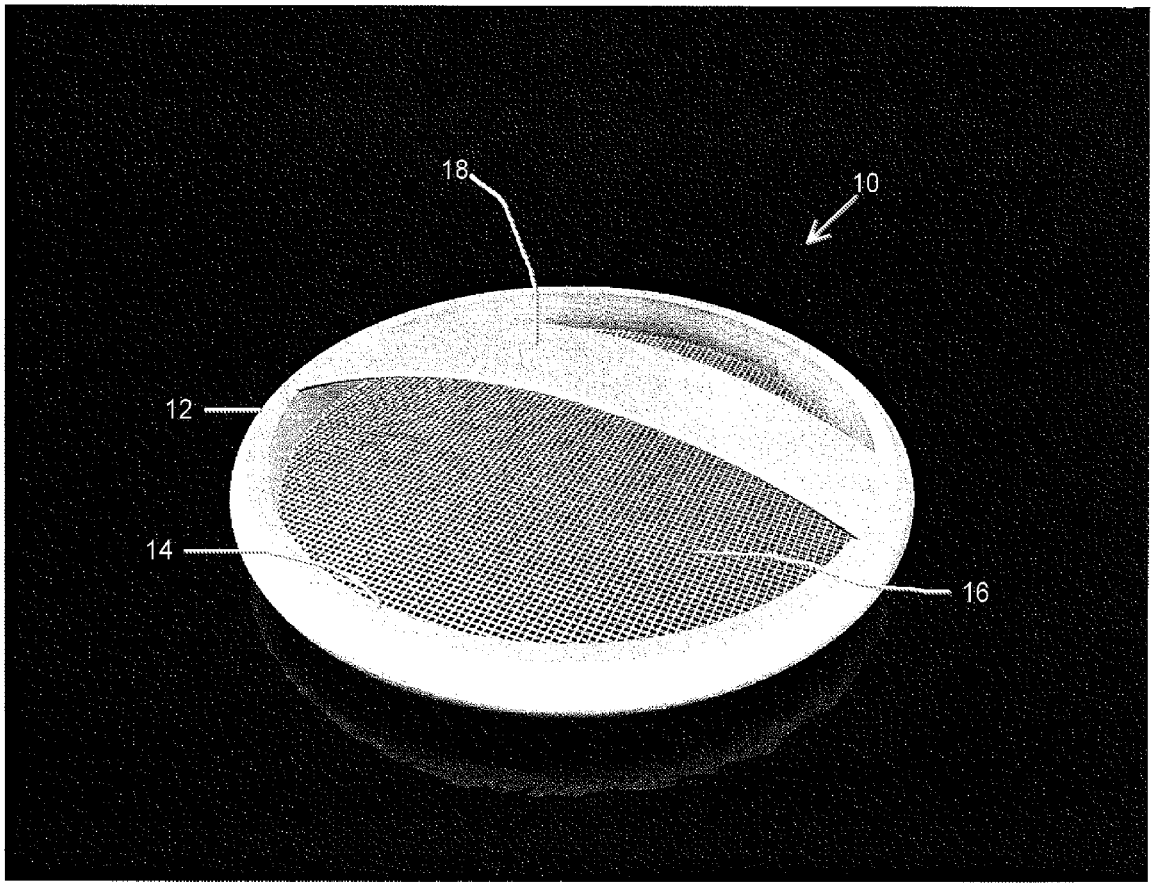
FIG. 1 is a top perspective view of a skimming screen in accordance with the present invention.

Referring now to the drawings, there is shown a skimming screen 10 which has a generally circular support frame 12. The support shown in the drawings has a circular cross section. However, it is contemplated that other shapes could be used. For example, rectangular, square, or flat shapes could be used. The support frame may be solid or hollow. In general, the support frame should be constructed to provide sufficient rigidity so that the skimming screen 10 will not easily distort. Too much distortion is undesirable because it may result in gaps between the skimming screen and the intake orifice that would permit debris to enter the suction line and get into the pump or filter. The skimming screen 10 is preferably made of a molded plastic material to permit easy manufacture and mass production, and to avoid corrosion.

The support frame 12 has a central opening 14. Screen or mesh fabric 16 is attached to the support frame 12 and extends over substantially the entirety of the central opening 14. The screen fabric should be sufficiently fine to trap small debris such as leaves, pine needles, and insects that are usually caught in the strainer basket. The screen is preferably flat, but may be convex or concave.

Figure 2:
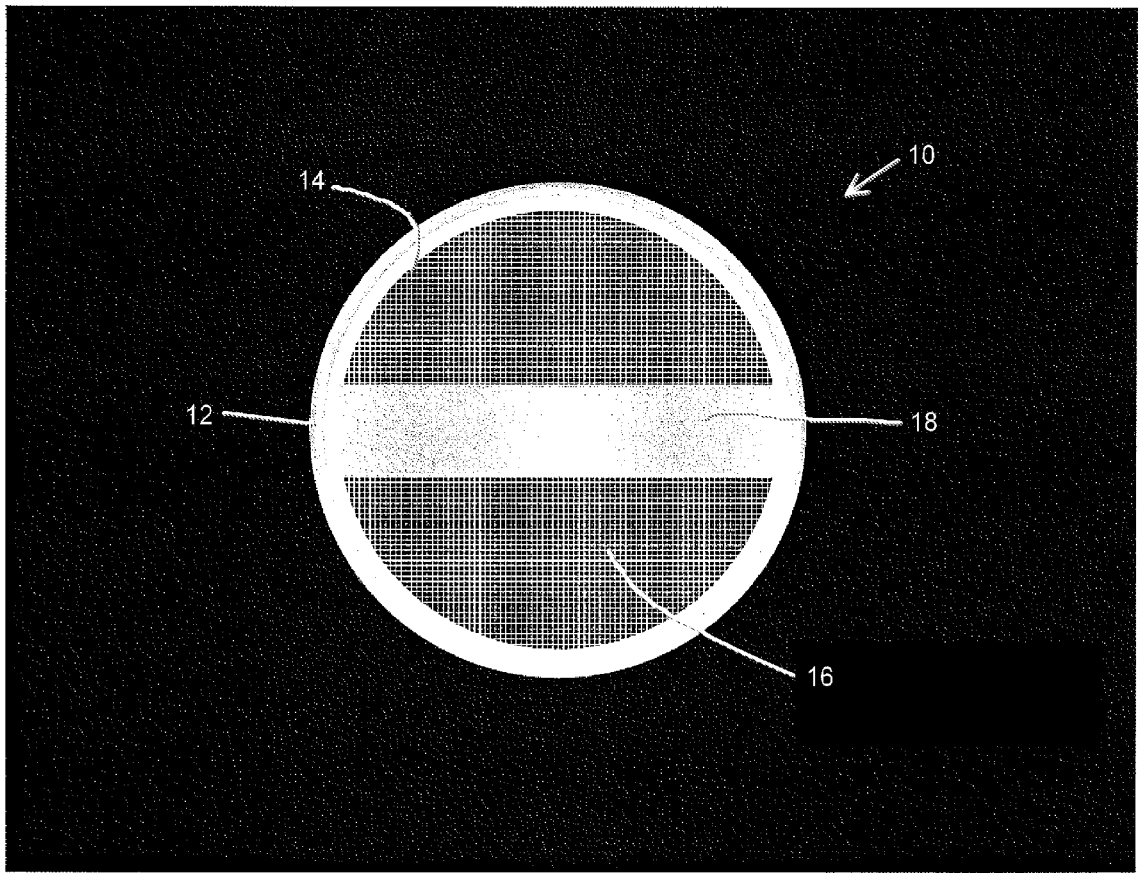
FIG. 2 is a top plan view of the skimming screen shown in FIG. 1.
Figure 3:
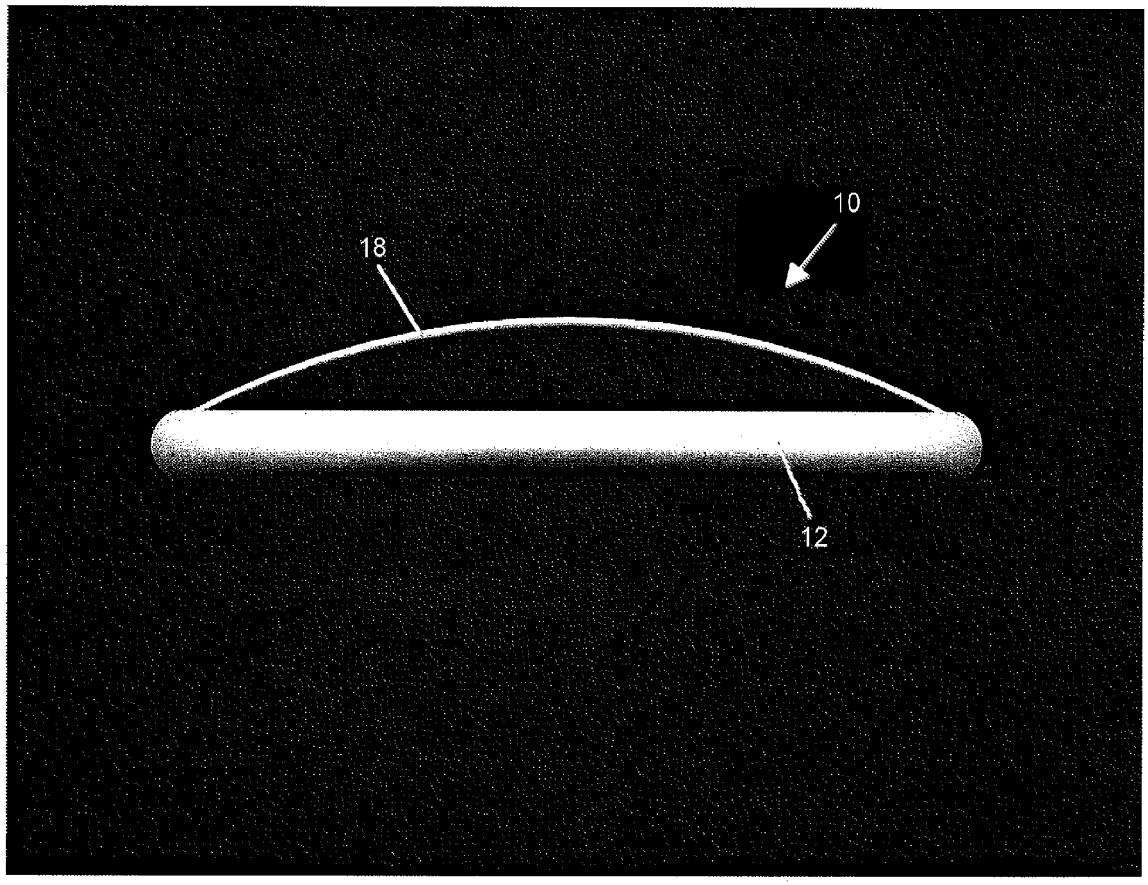
FIG. 3 is a side elevation view of the skimming screen shown in FIG. 1.
Figure 4:
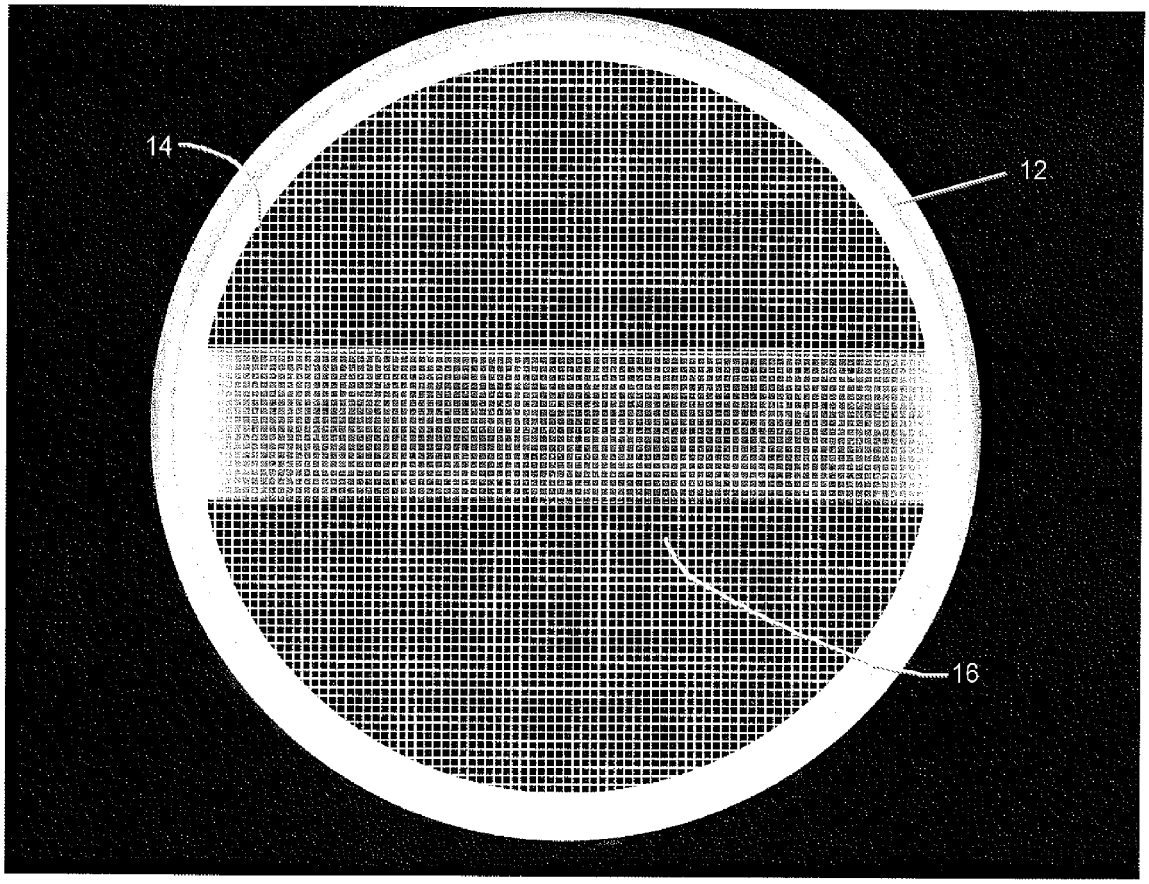
FIG. 4 is a bottom plan view of the skimming screen shown in FIG. 1.

The skimming screen 10 is dimensioned and shaped to sit on the intake orifice in the strainer basket chamber of a swimming pool skimmer. Although the skimming screen 10 shown in FIGS. 1-4 has a circular shape, it will be appreciated that the skimming screen according to this invention can be formed in any shape to accommodate intake orifices or skimmer chambers of various sizes and geometries. Also, although the handle 18 is shown as an arcuate piece having an essentially flat profile, it can also be embodied in other shapes. The handle 18 may also be configured as one or more tabs or loops that extend from the support frame. In general, the handle 18 is configured and arranged to facilitate the installation and removal of the skimming screen 10 to and from the intake orifice of the pool skimmer suction line.

The skimming screen according to the present invention is used to facilitate the cleaning of the strainer basket in a pool skimmer. To that end, when it is necessary to clean out the strainer basket, the basket is removed from the intake orifice and the skimming screen is placed in the bottom of the strainer basket chamber over the suction line intake orifice. When in place, the skimming screen catches any floating debris that would otherwise be drawn into the filtration system through the suction line. After the strainer basket has been cleaned, the skimming screen is removed from the skimmer chamber and the strainer basket is returned to its operative position.

The placement of the skimming screen over the intake orifice allows the pool filtration system to remain running while the strainer basket and the skimmer chamber are cleaned. By using the skimming screen according to the present invention, pool owners and maintenance personnel can save a substantial amount of time by not having to turn off the filtration system to clean the strainer basket and chamber. The use of the skimming screen as described herein also eliminates the steps of shutting down and starting up the pool filtration system which can save wear on that equipment. Also, because the filtration system can keep running while the strainer basket and chamber are being cleaned the skimming system can continue to remove floating debris from the surface water. Any additional debris that would otherwise be drawn into the skimmer chamber is caught by the skimming screen. It will be appreciated that the use of the skimming screen according to this invention results in a significant reduction in the time and energy used to clean the strainer basket and chamber and avoids the inconvenience of having to shut down the pool filtration system in order to clean out the strainer basket and chamber perhaps numerous times.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

What is claimed is:

1. A method of cleaning a strainer basket in the skimmer of a swimming pool having a pool water filtration system, said method comprising the steps of:

providing a skimming screen having a support frame that has a central opening and a screen attached to the support frame, wherein the screen extends over substantially the entire area of the central opening;

removing the strainer basket from an intake orifice of a skimmer suction line for cleaning; and then placing the skimming screen on the intake orifice, whereby the pool filtration system can be kept running while the strainer basket is being cleaned.

2. A method as claimed in claim 1 comprising the steps of cleaning the strainer basket, removing the skimming screen from the intake orifice after said cleaning step, and then replacing the strainer basket in the intake orifice.

3. A method as claimed in claim 2 comprising the step of running the pool filtration system during the removing, cleaning, and replacing steps.

4. A method as claimed in claim 1 wherein the step of providing the skimming screen comprises the step of forming a handle that extends from one side of the support frame to another side thereof.

5. A method as claimed in claim 1 wherein the step of providing the skimming screen comprises the step of forming the support frame with a ring shape.

6. A method as claimed in claim 5 comprising the step of forming a handle that extends diametrically across the ring-shaped support frame.

7. A method as claimed in claim 6 wherein the handle is formed with an arcuate shape.

8. A method as claimed in claim 1 comprising the step of running the pool filtration system during the removing and replacing steps.

9. A method as claimed in claim 1 wherein the step of providing the skimming screen comprises the step of forming the skimming screen by molding plastic material.

10. A method of cleaning a strainer basket in the skimmer of a swimming pool having a pool water filtration system, said method comprising the steps of:

(a) providing a skimming screen having a support frame that has a central opening and a screen attached to the support frame, wherein the screen extends over substantially the entire area of the central opening;

(b) removing the strainer basket from an intake orifice of a skimmer suction line for cleaning;

(c) placing the skimming screen on the intake orifice after said strainer basket is removed;

(d) cleaning any debris from the strainer basket; then (e) removing the skimming screen from the intake orifice;

(f) replacing the strainer basket in the intake orifice; and (g) running the pool water filtration system during the performance of steps (b), (c), (d), (e), and (f).

11. A method as claimed in claim 10 wherein the step of providing the skimming screen comprises the step of forming a handle that extends from one side of the support frame to another side thereof.

12. A method as claimed in claim 10 wherein the step of providing the skimming screen comprises the step of forming the support frame with a ring shape.

13. A method as claimed in claim 12 comprising the step of forming a handle that extends diametrically across the ring-shaped support frame.

14. A method as claimed in claim 13 wherein the handle is formed with an arcuate shape.

15. A method as claimed in claim 10 wherein the step of providing the skimming screen comprises the step of forming the skimming screen by molding plastic material.

* * * * *